United States Patent [19]

Lovik

[11] Patent Number: 5,024,012

[45] Date of Patent: Jun. 18, 1991

[54] EXPANDABLE BALLOON WRAPPED MEDIA DISPLAY SYSTEM

[76] Inventor: Craig J. Lovik, 8565 Custer School Rd., Custer, Wash. 98240

[21] Appl. No.: 325,882

[22] Filed: Mar. 20, 1989

[51] Int. Cl.[5] ..... G09F 21/06; G09F 1/06; G09F 1/12

[52] U.S. Cl. ..... 40/212; 40/539; 446/220; 428/9

[58] Field of Search ..... 40/212, 213, 214, 215, 40/216, 217, 584, 538, 539; 446/220, 226; 428/9, 12

[56] References Cited

U.S. PATENT DOCUMENTS

| | | | |
|---|---|---|---|
| 1,203,967 | 11/1916 | Bowers | 40/1 |
| 1,211,369 | 11/1917 | Miller | 446/222 |
| 1,471,886 | 10/1923 | Dessau | 446/220 |
| 2,927,383 | 3/1960 | Longino | 446/222 |

*Primary Examiner*—Kenneth J. Dorner
*Assistant Examiner*—James M. Gardner
*Attorney, Agent, or Firm*—Cassidy, Vance & Tarleton, P.S.

[57] ABSTRACT

An expandable balloon wrapped media display system including: a transparent balloon; an accordion pleated paper-like sheet having formed thereon a message, picture, graphic display, graphic design, or combination thereof; a first attachment member fixedly secured to a first edge of the sheet; the sheet being folded up on itself at its midpoint so as to present the left and right halves of a second edge thereof in generally face-to-face relation; a second attachment member having a tubular portion and an axially extending flange fixedly secured to a second edge of the sheet; the folded accordion pleated sheet being inserted into a balloon with the first attachment member engaging the polar extremity of the balloon most remote from the balloon's inflation aperture and the second attachment member having its tubular portion disposed within the constricted neck portion of the balloon; first attachment means securing the first polar extremity of the balloon to the first attachment member; and, second attachment means securing the constricted neck portion of the balloon to the tubular member, whereupon inflation of the balloon causes its sidewall to stretch and enlarge, thus causing the first and second attachment members to move away from one another so as to unfold the accordion pleated sheet and thus expose the media formed thereon to observers through the balloon's transparent sidewall.

21 Claims, 8 Drawing Sheets

EXPANDABLE BALLOON WRAPPED MEDIA DISPLAY SYSTEM

BACKGROUND OF THE INVENTION

1. Technical Field

The present invention relates generally to novelty items; and, more particularly, to an expandable greeting card or similar media display device adapted to be fixedly positioned within a relatively clear transparent inflatable balloon so that upon inflation of the balloon the card is gradually expanded to render messages and/or pictorial or graphic displays printed thereon visible to an observer through the sidewall of the inflated balloon. More specifically, the present invention relates to a balloon encased expandable greeting card and/or pictorial display device Which may be gradually expanded by coaction with the sidewall of the balloon as the latter is inflated so as to render the printed media contained thereon—whether in the form of a printed message, a picture, a graphic design or display, or a combination of the foregoing—visible to individuals through the wall of the balloon, together with a novel method for displaying such printed media.

2. Background Art

There are many occasions When persons desire to convey messages to one or more other persons in some unusual format such, for example, as a greeting card which may or may not contain text material and/or graphic displays of the type commonly exchanged upon such occasions as birthdays, anniversaries, weddings, graduations and a wide range of similar festive occasions. Moreover, it is common that inflatable balloons are also widely used at such festivities. Indeed, special purpose balloons bearing printed messages and/or graphic displays printed on the balloon sidewall are well known for use in conveying birthday greetings, Valentine Day greetings, etc.

Additionally, a wide range of devices and/or systems have been devised in recent years to enable toys, gifts, flowers, trinkets and similar favors to be stuffed into an inflated balloon with the balloon serving as an attractive, and oft-times unique, package for the particular favor. Thus, in those instances where the balloon sidewall is clear or transparent, the recipient and others are able to view the favor contained therein; whereas, in other instances where the balloon sidewall is opaque, the favor remains hidden until the balloon is burst by the recipient, thus promoting surprise.

However, apart from the long-standing widespread use of balloons as conventional party favors and the like, and the more limited use in recent years of balloons as containers and/or gift packages for toys, flowers, small gifts and similar party favors, to the best of the present inventor's knowledge, prior to the advent of the present invention there has been no use of, nor suggestion of the utility of, balloons as envelopes for greeting cards and/or similar media presentation devices for delivering greetings and/or displaying pictures and/or graphic media.

SUMMARY OF THE INVENTION

The present invention provides a simple, effective and economic novelty item utilizing balloons as packages for greeting cards and/or similar objects containing pictorial, graphic and/or similar display media printed thereon—hereinafter severally and collectively termed "media display device(s)"—wherein the inherent nature of the balloon to expand during inflation is used to open or unfold an accordion pleated media display device mounted therein so as to gradually expose the printed media thereon. To this end, the media display device of the present invention is preferably first folded in accordion pleated fashion into a compact, elongate, folded configuration. A first attachment member is then secured to the midpoint of one edge of the accordion pleated media display device, with the accordion pleated device then being folded at its midpoint so that the opposite edge of the accordion pleated device is folded over upon itself with the two (2) halves of the thus folded over opposite edge lying in essentially face-to-face relation. A second attachment member including a generally tubular element and an axially extending flange portion is then secured to the folded media display device by securing the axially extending flange between and to the two (2) facing halves of the folded over opposite edge of the accordion pleated media display device with the tubular element extending axially from one end of the device and the first attachment member extending axially from the opposite end thereof.

Thus, the arrangement is such that the folded accordion pleated media display device can be easily inserted through the inflation aperture and constricted neck portion of a conventional balloon prior to inflation of the latter. Upon insertion, the first attachment member is fixedly secured to the inner end of the balloon sidewall at the apex thereof most remote from the inflation aperture—for example, with a suitable adhesive or by placing a small O-ring, C-clamp or rubberband about the outside of the balloon sidewall in surrounding relation to the overlapping portion of the sidewall and the first attachment member. In like manner the tubular portion of the second attachment member is fixedly secured within the inboard end of the balloon's constricted neck portion utilizing adhesive, a rubberband, or a suitable small O-ring or clamp, while leaving the outboard end of the constricted neck portion unobstructed so as to permit knotting thereof or otherwise tying off of the constricted neck portion following inflation of the balloon.

In use, the balloon can be inflated in a completely conventional manner—e.g., manually by blowing into the constricted neck portion and through the tubular member, or automatically using an inflation pump or the like. As the balloon is inflated with its sidewall stretching from the relaxed uninflated state through a partially inflated/stretched state to a fully inflated/stretched state, the fact that the first and second attachment members are fixedly secured to the inner balloon sidewall at respective opposite polar locations causes the accordion pleated folded media display device to gradually unfold, thereby rendering the printed media thereon visible to an observer through the clear or transparent sidewall of the balloon.

DESCRIPTION OF THE DRAWINGS

These and other objects and advantages of the present invention will become more readily apparent upon reading the following Detailed Description and upon reference to drawings, in which.

Figure 1:
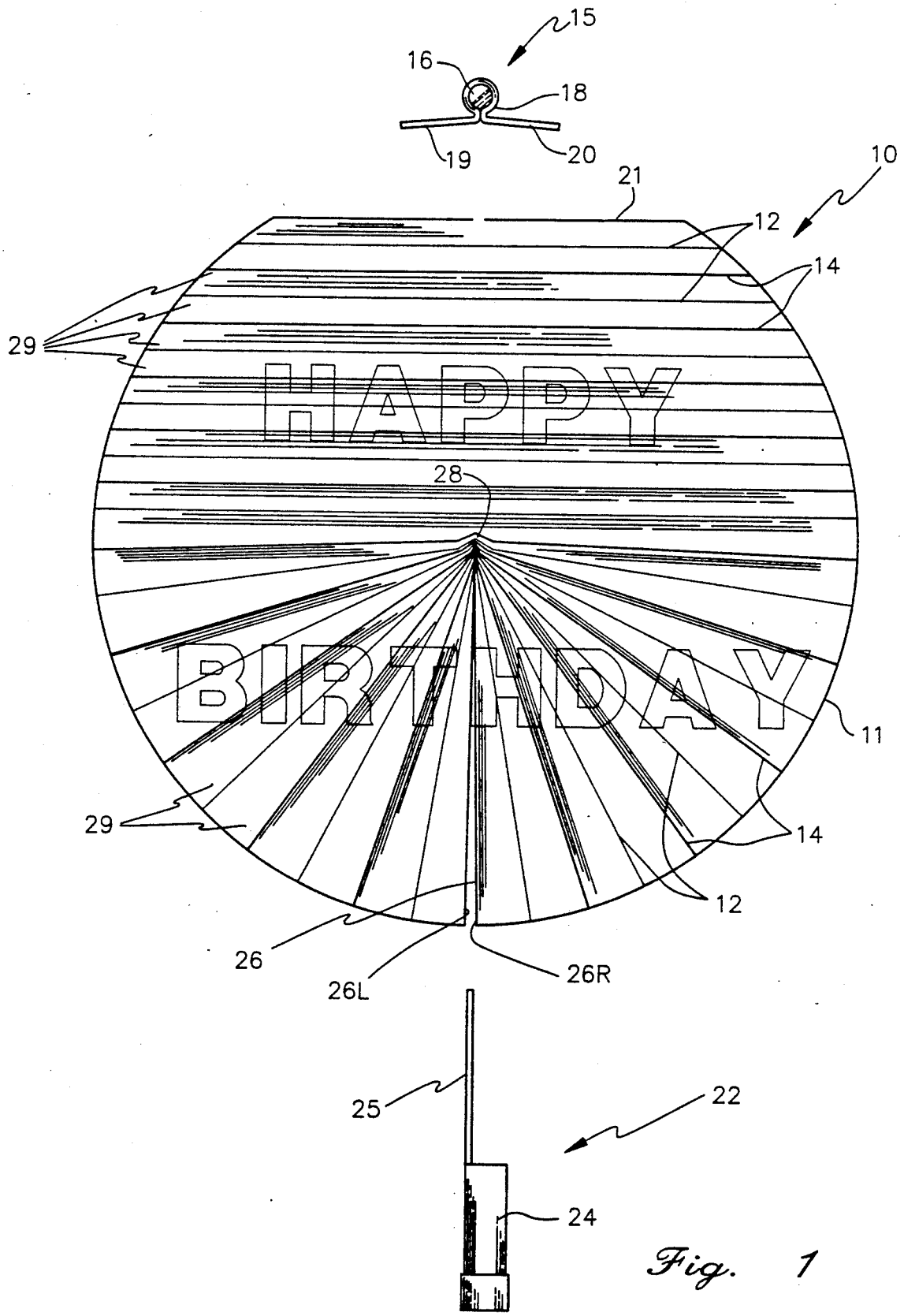
FIG. 1 is an exploded elevational view of a typical media display device embodying features of the present invention in accordance with one exemplary embodiment thereof, here depicting an accordion pleated paper-like media display element in the expanded state, together with first and second attachment members prior to attachment thereof to the paper-like display element, and all prior to insertion into a conventional uninflated balloon.

While the invention is susceptible of various modifications and alternative forms, specific embodiments thereof have been shown by way of example in the drawings and will herein be described in detail. It should be understood, however, that it is not intended to limit the invention to the particular forms disclosed but, on the contrary, the intention is to cover all modifications, equivalents and/or alternatives falling within the spirit and scope of the invention as expressed in the appended claims.

DETAILED DESCRIPTION

Figure 2:
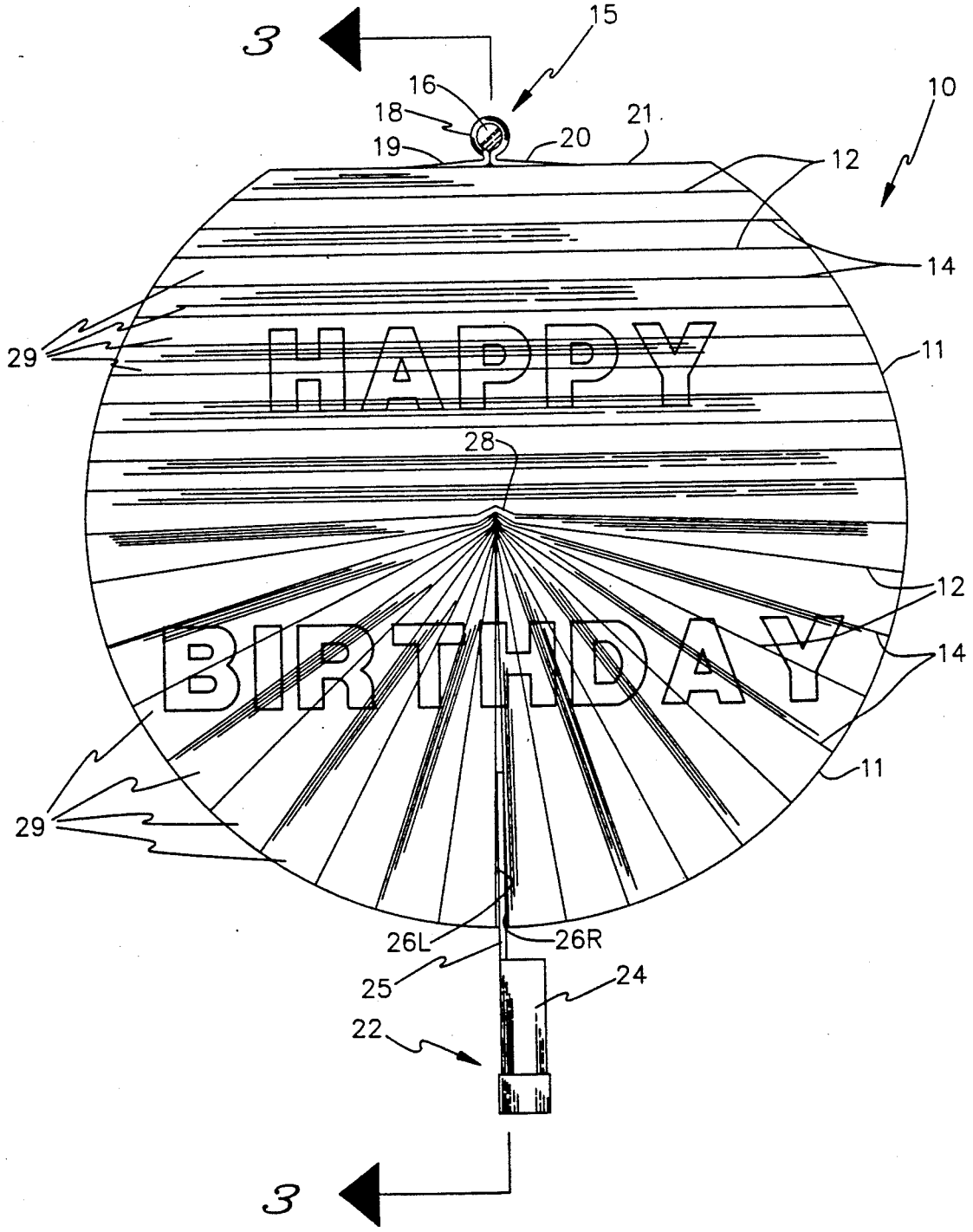
FIG. 2 is an elevational view similar to that shown in FIG. 1, but here illustrating the three (3) basic components of the media display device in assembled form and in the expanded configuration that they would assume following inflation of a balloon within which they have been mounted.
Figure 3:
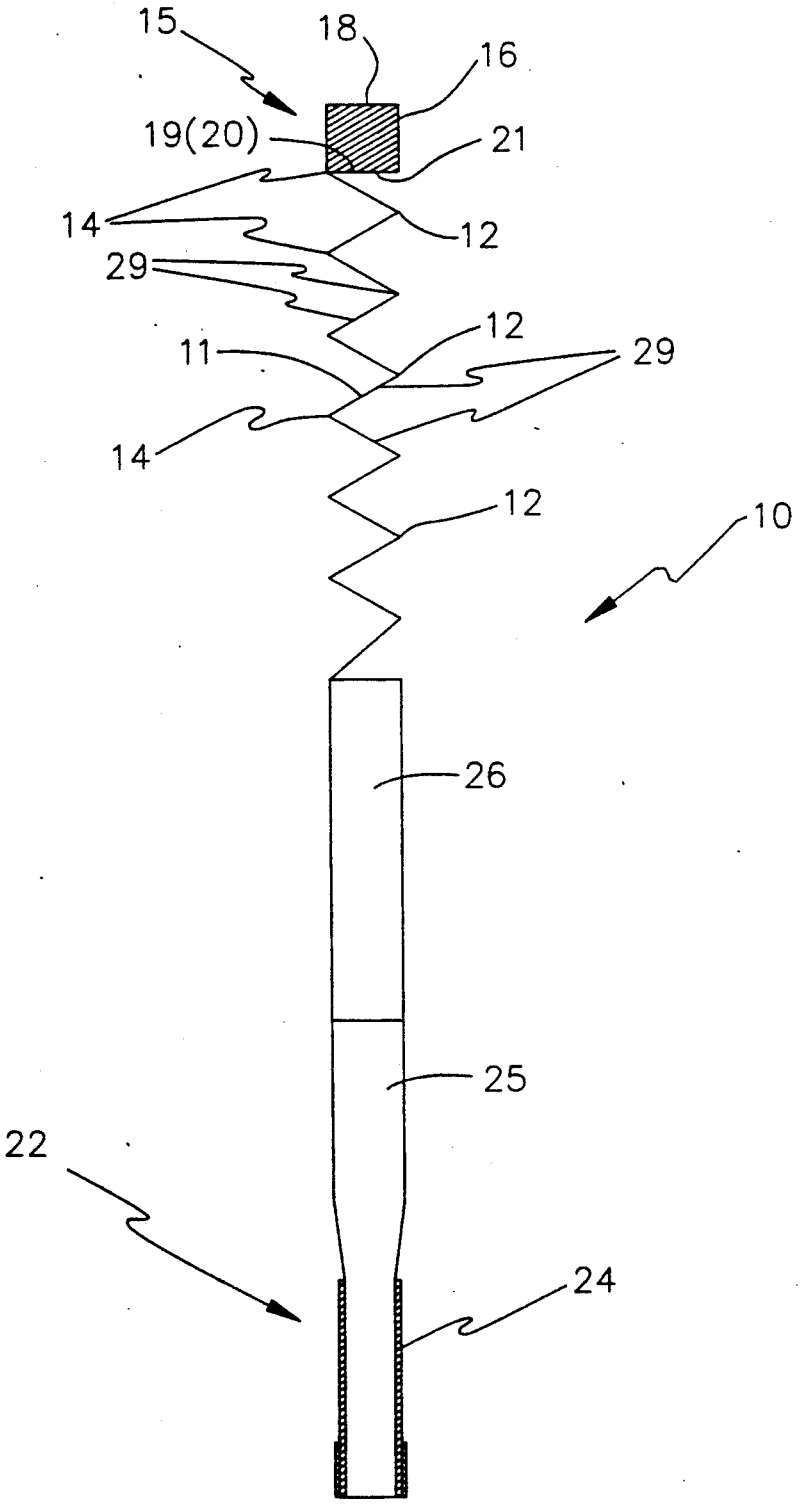
FIG. 3 is a sectional view taken substantially along the line 3—3 in FIG. 2, here illustrating details of the manner of attachment of the three (3) basic components of the media display device to one another.

Referring now to the drawings, and directing attention first to FIGS. 1 through 3 conjointly, an exemplary media display device embodying features of the present invention, here generally indicated at 10, has been illustrated. Thus, as here shown, the device 10 includes a paper-like display element 11—which may, but need not, be somewhat rounded or ovate in configuration so as to generally conform in external configuration to the shape of a conventional inflated balloon (not shown in FIGS. 1-3)—which is accordion pleated by providing a plurality of alternate, oppositely folded, parallel fold lines 12, 14. A first attachment member, generally indicated at 15, comprising a rigid axially extending member 16 secured within an enveloping paper-like tab 18 having a pair of laterally extended flanges 19, 20 is fixedly secured to one outermost folded edge of the accordion pleated media display element 11—here, the uppermost edge 21 as viewed in FIGS. 1-3—for example, by any suitable means such as adhesive, staples, or the like (not shown). Thus, the attachment member 15 provides a means for attaching one end of the expandable accordion pleated media display device 10 to the polar end of a balloon (not shown in FIGS. 1-3) most remote from the balloon—s inflation aperture.

In accordance with one of the important aspects of the present invention, a second attachment member, generally indicated at 22, is provided having dual functions—viz., i) providing a mechanism for attaching the media display device 10 to the polar end of the balloon comprising the inflation aperture and constricted neck thereof; and ii), also enabling the balloon to be inflated in a completely conventional manner. To accomplish this, the second attachment member 22 preferably includes a relatively rigid, hollow, tubular member 24 terminating at one end in a generally axially extending flange 25. Thus, in order to assemble the second attachment member 22 to the paper-like display element 11, the edge of the accordion pleated display element 11 most remote from edge 21—e.g., here, the lowermost edge 26—is folded upon itself about its midpoint 28 into a generally V-shaped configuration comprising a pair of slightly diverging edge halves 26L, 26R. Flange 25 on the second attachment member 22 is interposed between the edge halves 26L, 26R and fixedly secured thereto in any suitable manner such, for example, as with adhesive, staples, or the like (not shown).

Figure 4:
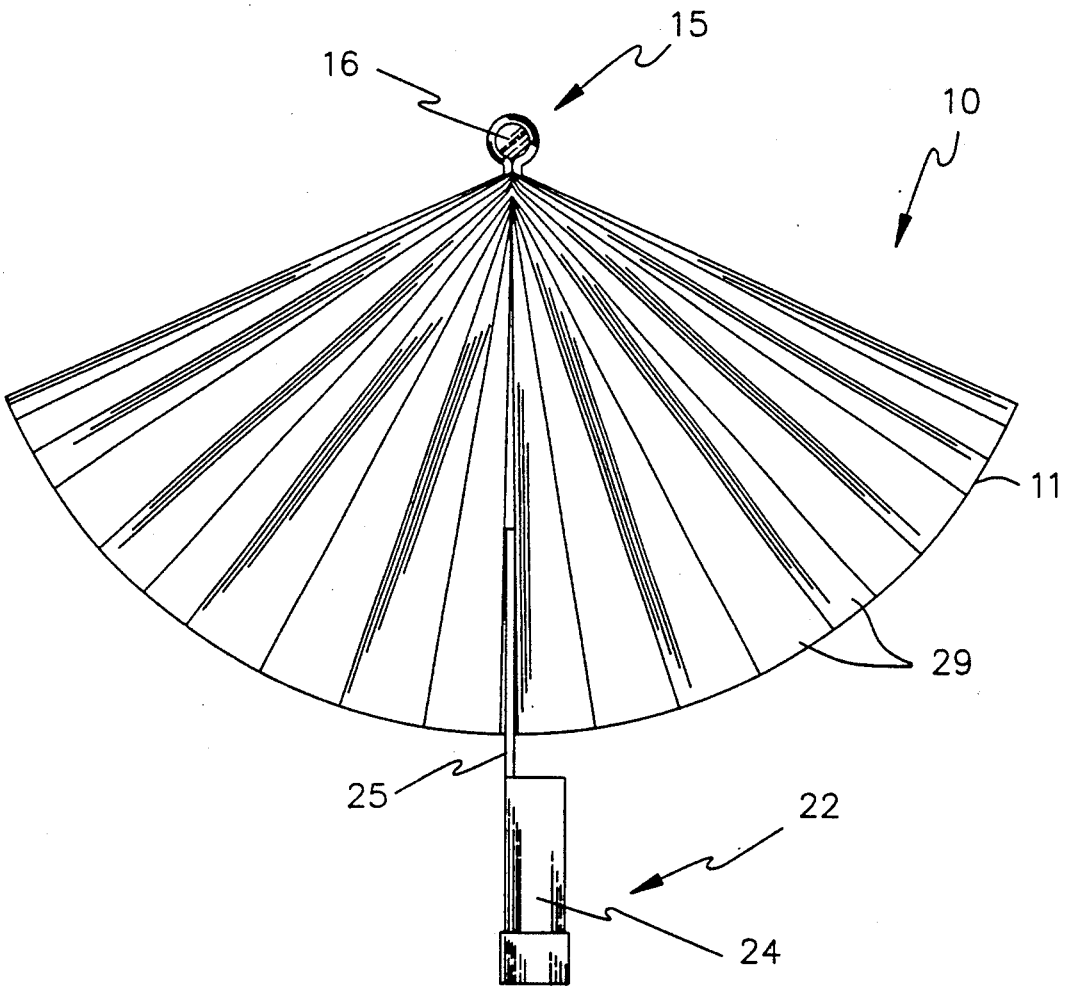
FIG. 4 is an elevational view of the assembled media display device depicted in FIG. 2, but here illustrating the device in partially folded form.
Figure 5:
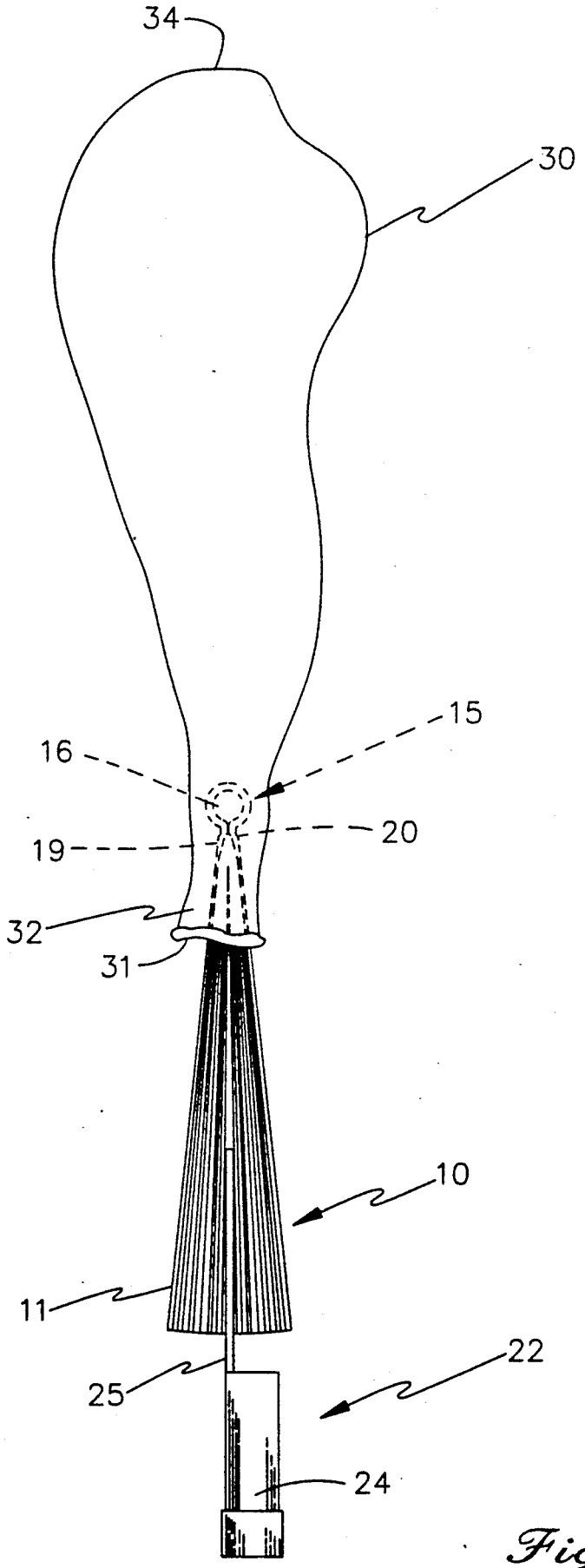
FIG. 5 is an elevational view of the device shown in FIGS. 1 through 4, here depicting the device in substantially fully folded condition and in the process of being inserted through the inflation aperture and constricted neck portion of a conventional uninflated balloon.

In order to prepare the thus assembled media display device 10 for insertion into a conventional uninflated balloon, it is merely necessary to first fold the upper half of the accordion pleated device into a compact lineal configuration with each of the longitudinal segments 29 defined by adjacent opposite folds 12, 14 lying in intimate face-to-face abutting compact. The entire accordion pleated media display device 10 is then folded upon itself about the midpoint 28 thereof into the progressively more compact forms illustrated in FIGS. 4 and 5; and, upon reaching the fully collapsed and folded configuration depicted in FIG. 5, is ready for insertion into a completely conventional uninflated balloon such as that depicted at 30.

In carrying out the invention the folded accordion pleated expandable media display device 10 is inserted axially through the inflation aperture 31 and constricted neck portion 32 of the balloon 30, with the first attachment member 15 being directed towards the polar end 34 of the balloon 30 most remote from the inflation aperture 31. Thus, when fully inserted into the conventional uninflated balloon 30, the accordion pleated, folded, expandable media display device 10 and balloon 30 occupy the relative positions depicted in FIG. 6. At this point, it is merely necessary to fixedly secure the first attachment member 15 to the inner surface of the balloon sidewall at polar end 34, while also fixedly securing the second attachment member within the opposite polar end of the balloon defined by the latter's constricted neck portion 32. Any suitable means can be employed for this purpose including, merely by way of example, an adhesive applied to both the first attachment member and the outer surface of the tubular member 24 on the second attachment member 22 prior to insertion of the device 10 into the balloon.

Alternatively, the media display device 10 can be fixedly secured in place within balloon 30 by employing suitable separable fasteners such as external clamping means surrounding those portions of the balloon 30 overlying the first and second attachment members 15, 22. For example, a flexible O-ring 35 can be slipped over the polar portion 34 of the balloon 30 surrounding the first attachment member 15, while the constricted neck portion 32 of the balloon can be fixedly secured to the tubular portion 24 of the second attachment member 22 using a rubberband 36. Of course, those skilled in the art will appreciate that the O-ring 35 could be replaced with a rubberband 36; the rubberband 36 could be replaced with an O-ring 35; or, if desired, other types of conventional clamping arrangements could be employed to secure the two attachment members 15, 22 to the balloon 30 at its polar extremities 32, 34.

Figure 7:
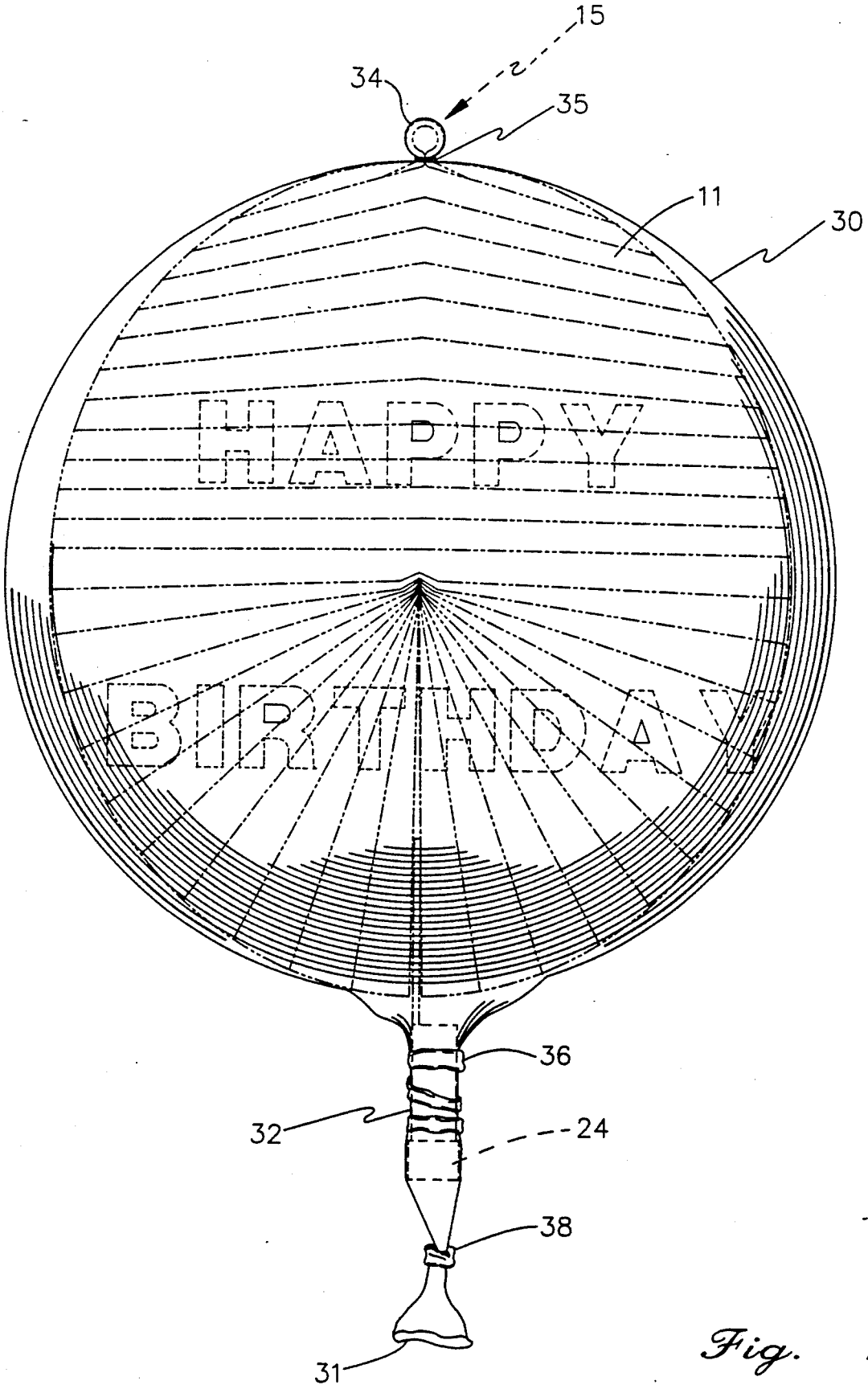
FIG. 7 is an elevational view of a fully inflated balloon following insertion of the media display device therein and attachment thereto, here depicting the assembly with the media display device fully open and visible through the clear or transparent sidewall of the balloon.

Once the accordion pleated, folded, expandable media display device 10 is positioned within the balloon 30 and fixedly secured thereto at the balloon's polar extremities 32, 34, it is merely necessary to inflate the balloon in a completely conventional manner by blowing through the inflation aperture or otherwise introducing an inflation medium—e.g., air, helium, or the like—therethrough. Since the axially projecting portion 24 of the second attachment member 22 is tubular and is fixedly positioned within the constricted neck portion 32 of the balloon 30, air or other inflation medium is readily permitted to pass into and pressurize the interior of the balloon, causing the latter to gradually inflate and enlarge in a completely conventional manner. As the balloon 30 is inflated, the polar extremities 32, 34 tend to gradually move away from one another as the balloon 30 enlarges; and, since the first and second attachment members 15, 22 are fixedly secured to: i) respective different ones of the upper and lower edges 21, 26 of the media display element 11; and ii), respective different ones of the polar extremities 34, 32 of the balloon 30, the act of balloon inflation serves to gradually unfold the accordion pleated, folded, expandable media display device 10 disposed within the interior of the balloon 30, with any written, graphic, pictorial or other visually observable media formed thereon being visible through the clear transparent sidewall of the balloon as best observed upon inspection of FIG. 7. When fully inflated, the balloon 30 and media display device 10 will appear as shown in FIG. 7; and, the constricted neck portion 32 of the balloon 30 extending beyond the tubular portion 24 of the second attachment member 22 may be tied off to seal the balloon in any conventional manner—such, for example, as by knotting as indicated at 38.

Figure 8:
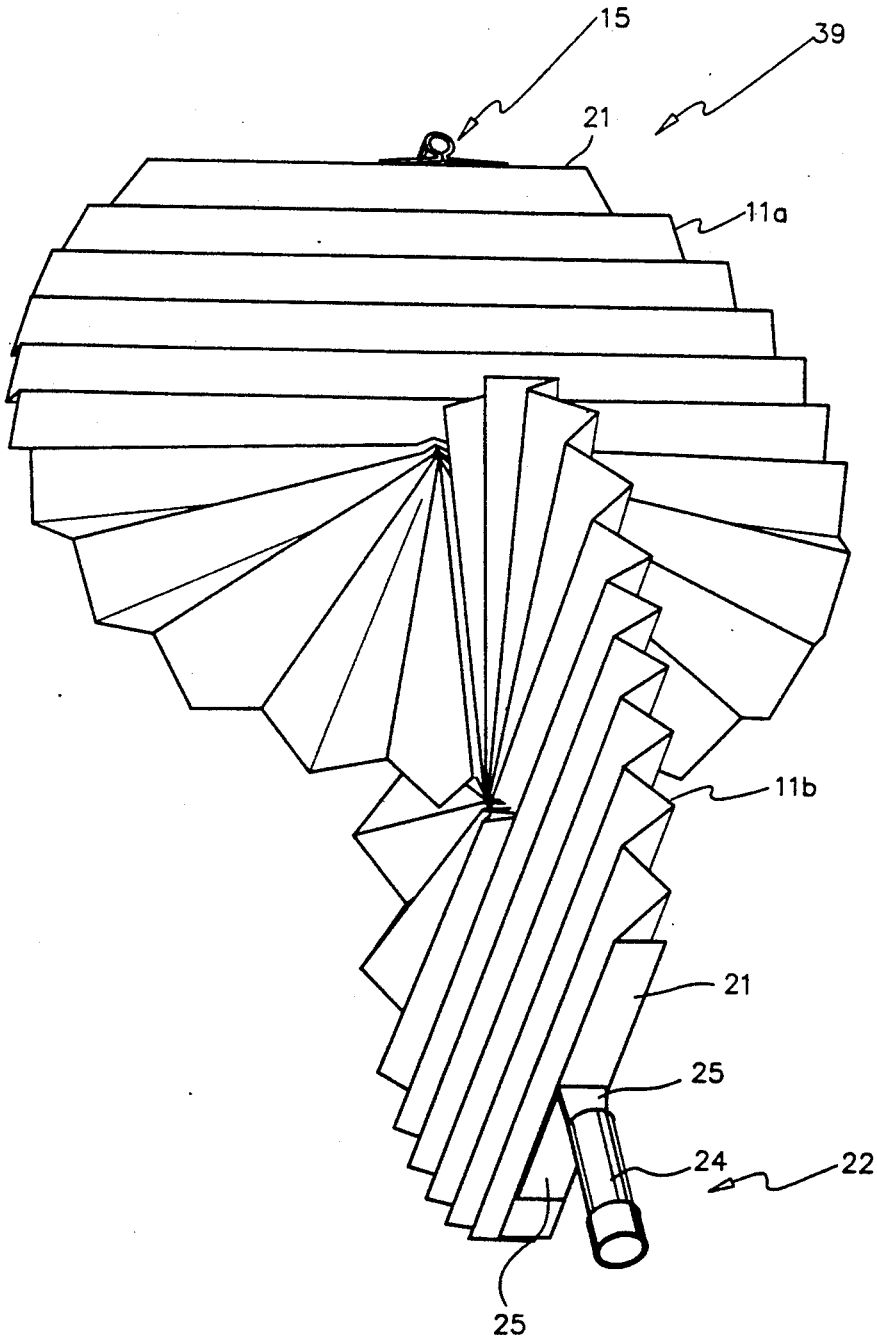
FIG. 8 is an isometric view of a modified type of media display device somewhat similar to that shown in FIG. 2, but here employing a pair of accordion pleated paper-like display elements secured to one another in end-to-end relation with the first and second attachment members being secured at opposite ends of respective different ones of the two (2) accordion pleated elements so as to form a three-dimensional media display device capable of insertion in a conventional uninflated balloon.

Turning now to FIG. 8, a slightly modified form of media display device, generally indicated at 39, has been shown. Thus, as here indicated, a pair of accordion pleated display elements **11*a*, 11*b* are provided, each being essentially identical to one another and to the display element 11 depicted in, and previously described in connection with, FIG. 1. In this instance, however, the element 11*b* is inverted and its folded-over V-shaped lowermost edge 26L, 26R (now the uppermost edge which is not visible in FIG. 8) is fixedly secured to the lowermost edge 26L, 26R (not visible in FIG. 8) of the display element 11*a* with display elements 11*a* and 11*b* being disposed at generally right angles to one another. The first attachment member 15 is secured to the uppermost edge 21 of display element 11*a* in precisely the same manner as previously described in connection with the embodiment of the invention depicted in FIGS. 1 and 2. In this instance, however, the flange 25 on the second attachment member 22 is folded through an angle of 90 degrees and is attached to edge 21 of display element 11*b***.

Figure 6:
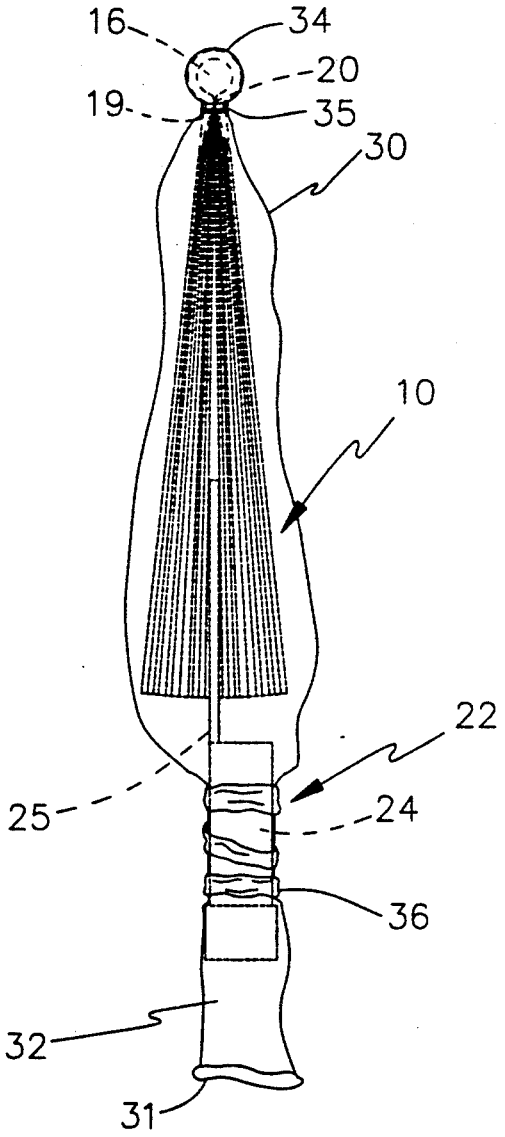
FIG. 6 is an elevational view similar to that shown in FIG. 5, but here illustrating the media display device fully inserted into an uninflated balloon and secured in place by means of separable external fasteners.

Thus, the arrangement is such that when the accordion pleated, folded, expandable media display device 39 is fully folded in a manner similar to the device 10 shown in FIG. 5, it can be inserted into, and secured within, a balloon in a manner identical to that previously described in connection with the description of FIGS. 5 and 6. However, when the balloon is inflated and the compact media display elements **11*a*, 11*b* are expanded, they will form first and second media display elements 11*a*, 11*b* in the upper and lower halves of the balloon which are disposed at substantially right angles with respect to one another, thereby forming an essentially three-dimensional media display device 39 which can be viewed through the clear transparent balloon sidewall (not shown in FIG. 8**) from virtually any perspective.

Thus, those persons skilled in the art will appreciate that there have herein been described simple, yet highly effective, systems for displaying pictures, cartoon characters and/or personal messages and greetings on a paper-like accordion pleated card disposed within a conventional balloon wherein the greeting, message or other pictorial or graphic display is gradually revealed to the balloon recipient and others as he/she inflates the balloon. The particular materials from which the accordion pleated media display devices 10, 39 are made is not critical to the invention. Thus, excellent results have been achieved utilizing simply paper materials to form the display elements **11, 11*a*, 11*b* and the first and second attachment members 15, 22. However, if desired, one or more of the components can be formed of cardboard, paperboard, plastic and/or plastic coated paper products. It is important, however, that whatever material is used to form the tubular portion 24 of the second attachment member 22 be of sufficient thickness and rigidity as to maintain a self-supporting tubular configuration when in use so as to permit inflation of the balloon 30**. The balloons and media display devices can, if desired, be prepackaged in assembled but uninflated form; they can be packaged or otherwise delivered to the consumer in assembled inflated form; or, alternatively, they can be sold in kit form or as separate components, thereby enabling the purchaser to personalize the particular greeting, message or other visible media to be applied to the display devices.

I claim:

1. A media display device adapted to be inserted into, and secured to opposite polar extremities of, an uninflated conventional transparent balloon, said media display device comprising, in combination:

a) a media display element comprising at least one sheet of flexible foldable material capable of bearing thereon visually observable media in the form of a printed message, a picture, a graphic design, a graphic display, and combinations of the foregoing, said at least one sheet of flexible foldable material being folded in opposite directions along parallel fold lines into a lineally oriented, accordion pleated configuration having first and second exposed opposite edges;

b) first attachment means secured to said first exposed opposite edge of said at least one accordion pleated sheet;

c) second attachment means having a tubular portion and a generally axially extending flange, said flange being fixedly secured to said second exposed opposite edge of said at least one accordion pleated sheet; and, d) said at least one lineally oriented accordion pleated sheet being folded upon itself at its midpoint so as to orient the left and right halves of the folded portions of said accordion pleated sheet in essentially parallel, slightly diverging, coaxial relation with said first attachment means projecting axially from one end of said at least one folded over accordion pleated sheet and said second attachment means projecting axially from the opposite end of said at least one folded over accordion pleated sheet;

whereby, when said media display element is inserted axially into the interior of a conventional inflated transparent balloon through the inflation aperture and constricted neck portion thereof, said axially projecting portion of said first attachment means can be fixedly secured to the inner surface of the balloon sidewall at a polar location remote from the balloon's inflation aperture and said tubular portion of said second attachment means can be fixedly secured to the inner surface of the balloon's constricted neck portion, whereupon inflation of the balloon causes the balloon sidewall to stretch and enlarge, thereby gradually unfolding and exposing said accordion pleated media display element so as to gradually expose the visually observable media formed thereon to observers through the balloon's transparent sidewall.

2. A media display device as set forth in claim 1 which, when assembled and unfolded, has a generally ovate configuration so as to substantially conform in shape to an imaginary plane passing axially through a balloon when inflated.

3. A media display device as set forth in claim 1 wherein said first attachment means includes an axially extending projection for permitting attachment of said device to a polar extremity of a conventional uninflated balloon remote from the balloon's inflation aperture.

4. A media display device a set forth in claim wherein said at least one sheet is formed of paper-like material.

5. A media display device as set forth in claim 11 wherein said second attachment means is formed of paper-like material with said tubular portion having a thickness sufficient to render said tubular portion substantially rigid and self-supporting.

6. A media display device as set forth in claim 1 wherein said flange on said second attachment means is interposed between the left and right halves of said second exposed opposite edge of said accordion pleated sheet and fixedly secured thereto.

7. A media display device as set forth in claim 6 wherein said first attachement means is secured to said first exposed oppOsite edge of said at least one accordion pleated sheet at substantially the midpoint thereof.

8. A media display device as set forth in claim 1 wherein said media display element comprises at least two first and second sheets of flexible foldable material with each of said first and second flexible foldable sheets being folded in alternately opposite directions along parallel fold lines into a lineally oriented accordion pleated configuration having first and second exposed opposite edges, said first attachment means being secured to said first exposed edge of said first accordion pleated sheet, said second attachment means being secured to said first exposed edge of said second accordion pleated sheet, said first and second accordion pleated sheets each being folded upon itself about its midpoint so as to present the left and right halves of the second exposed edge of each sheet in face-to-face relation, and wherein said left and right halves of said second exposed edges of said first and second accordion pleated sheets are secured together with said second sheet lying generally in a plane normal to said first sheet when said media display element is unfolded.

9. A balloon encased printed and/or graphic media display device comprising, in combination:

a) a media display element comprising at least one sheet of flexible foldable sheet material capable of bearing thereon visual media in the form of a printed message, a picture, a graphic design, a graphic display, and/or combinations of the foregoing, said sheet of flexible foldable sheet material being folded in alternately opposite directions along parallel lines into a lineally oriented, accordion pleated configuration having first and second exposed opposite edges;

b) first attachment means fixedly secured to said first exposed opposite edge of said at least one accordion pleated sheet;

c) second attachment means having a tubular portion and a generally axially extending flange, said flange being fixedly secured to said second exposed opposite edge of said at least one accordion pleated sheet;

d) said at least one lineally oriented accordion pleated sheet being folded upon itself at its midpoint so as to orient the left and right halves of the folded portions of said accordion pleated sheet in essentially parallel, slightly diverging, coaxial relation with said first attachment means projecting axially from one end of said at least one folded over accordion pleated sheet and said second attachment means projecting axially from the opposite end of said at least one folded over accordion pleated sheet;

e) an uninflated balloon having a transparent sidewall, an inflation aperture and a constricted neck portion, said media display element having been inserted into the interior of said balloon through said inflation aperture and said constricted neck portion with said first attachment means engaging the inner polar extremity of said balloon most remote from said inflation aperture and said tubular member being disposed within said balloon's constricted neck portion;

f) first means for fixedly securing said polar extremity of said balloon remote from said inflation aperture to said first attachment means; and, g) second means for fixedly securing said constricted neck portion of said balloon to said tubular portion;

so that when said balloon is inflated by introducing air or other inflation medium through said inflation aperture, the inflation medium passes through said constricted neck portion and said tubular member into the interior of said balloon, causing said balloon to inflate and enlarge and thereby causing said first and second attachment means which are respectively secured to the interior of the balloon at opposite polar locations to move away from one another so as to unfold said accordion pleated media display element and permit viewing of the printed and/or graphic media thereon through the balloon's transparent sidewall.

10. A balloon encased printed and/or graphic media display device as set forth in claim 9 which, when assembled and unfolded, has a generally ovate configuration so as to substantially conform in shape to an imaginary plane passing axially through said balloon when inflated.

11. A balloon encased printed and/or graphic media display device as set forth in claim 9 wherein said first attachment means includes an axially extending projection for permitting attachment of said device to said polar extremity of said uninflated balloon remote from said balloon's inflation aperture.

12. A balloon encased printed and/or graphic media display device as set forth in claim 9 wherein said at least one sheet is formed of paper-like material.

13. A balloon encased printed and/or graphic media display device as set forth in claim 9 wherein said second attachment means is formed of paper-like material with said tubular portion having a thickness sufficient to render said tubular portion substantially rigid and self-supporting.

14. A balloon encased printed and/or graphic media display device as set forth in claim 9 wherein said flange on said second attachment means is interposed between said left and right halves of said second exposed opposite edge of said at least one accordion pleated sheet and fixedly secured thereto.

15. A media display device as set forth in claim 9 wherein said first attachment means is secured to said first exposed opposite edge of said at least one accordion pleated sheet at substantially the midpoint thereof.

16. A balloon encased printed and/or graphic media display device as set forth in claim 9 wherein said media display element comprises at least two first and second sheets of flexible foldable material with each of said first and second flexible foldable sheets being folded in alternately opposite directions along parallel fold lines into a lineally oriented accordion pleated configuration having first and second exposed opposite edges, said first attachment means being secured to said first exposed edge of said first accordion pleated sheet, said second attachment means being secured to said first exposed edge of said second accordion pleated sheet, said first and second accordion pleated sheets each being folded upon itself about its midpoint so as to present the left and right halves of the second exposed edge of each sheet in face-to-face relation, and wherein said left and right halves of said second exposed edges of said first and second accordion pleated sheets are secured together with said second sheet lying generally in a plane normal to said first sheet when said media display element is unfolded.

17. A balloon encased media display device as set forth in claim 9 wherein said first and second means for fixedly securing respective ones of said polar extremity and said constricted neck portion of said balloon to said first and second attachment members comprise at least one of an adhesive, a separable rubberband, a separable resilient O-ring, and/or a separable clamp means.

18. A balloon encased media display device as set forth in claim 9 in assembled uninflated form.

19. A balloon encased media display device as set forth in claim 9 in assembled inflated form.

20. A balloon encased media display device as set forth in claim 9 wherein said at least one accordion pleated sheet contains printed media and/or graphic media thereon.

21. A balloon encased media display device as set forth in claim 19 wherein said at least one accordion pleated sheet permits of application of printed, pictorial and/or graphic material by the consumer so as to personalize the displayed media.

* * * * *